US007473079B2

(12) United States Patent
Ogawa et al.

(10) Patent No.: US 7,473,079 B2
(45) Date of Patent: Jan. 6, 2009

(54) ELECTRIC COMPRESSOR WITH INVERTER

(75) Inventors: Nobuaki Ogawa, Otsu (JP); Yukihiro Fujiwara, Kusatsu (JP); Masahiko Makino, Shiga (JP); Makoto Yoshida, Kusatsu (JP); Yasuhiro Asaida, Kyoto (JP)

(73) Assignee: Panasonic Corporation, Osaka (JP)

( * ) Notice: Subject to any disclaimer, the term of this patent is extended or adjusted under 35 U.S.C. 154(b) by 737 days.

(21) Appl. No.: 10/727,513

(22) Filed: Dec. 5, 2003

(65) Prior Publication Data

US 2004/0109772 A1 Jun. 10, 2004

(30) Foreign Application Priority Data

Dec. 6, 2002 (JP) ..... 2002-355228

(51) Int. Cl.
*F04B 17/00* (2006.01)
*F04B 35/04* (2006.01)

(52) U.S. Cl. ..... 417/410.5; 417/410.1; 417/422

(58) Field of Classification Search ..... 417/410.5, 417/410.1, 422
See application file for complete search history.

(56) References Cited

U.S. PATENT DOCUMENTS

| | | | | |
|---|---|---|---|---|
| 6,544,009 | B2 | 4/2003 | Makion et al. | |
| 6,808,372 | B2 * | 10/2004 | Makino et al. | 417/410.5 |
| 2002/0039532 | A1 * | 4/2002 | Saito et al. | 417/310 |
| 2003/0002999 | A1 | 1/2003 | Sakurabayashi et al. | |
| 2003/0013343 | A1 | 1/2003 | Abe et al. | |
| 2003/0086800 | A1 * | 5/2003 | Kurihara et al. | 417/423.7 |

FOREIGN PATENT DOCUMENTS

| | | |
|---|---|---|
| JP | 7-151083 | 6/1995 |
| JP | 11-082352 | 3/1999 |
| JP | 2000-291557 | 10/2000 |
| JP | 2001-020865 | 1/2001 |
| JP | 2001-280552 | 10/2001 |
| JP | 2002-005024 | 1/2002 |
| JP | 2001-070743 | 3/2002 |
| JP | 2002-115686 | 4/2002 |
| JP | 2002-174178 | 6/2002 |
| JP | 2002-180984 | 6/2002 |
| JP | 2002-188574 | 7/2002 |
| JP | 2002-285981 | 10/2002 |

OTHER PUBLICATIONS

English Language Abstract JP No. 7-151083.
English Language Abstract JP No. 11-082352.

(Continued)

*Primary Examiner*—Devon Kramer
*Assistant Examiner*—Patrick Hamo
(74) *Attorney, Agent, or Firm*—Greenblum & Bernstein, P.L.C.

(57) ABSTRACT

In an electric compressor, an inverter case of an inverter is externally attached to an end wall of a housing in an axial direction on the side of a suction port to a compression mechanism. An intake passage for leading fluid returned from the outside into the suction port is provided in the inverter case. The intake passage has a thermal binding portion for thermally binding the intake passage to the inverter. According to the above structure, an exclusive part in the housing is eliminated even though the inverter is installed in the electric compressor, and the inverter is cooled efficiently.

12 Claims, 2 Drawing Sheets

OTHER PUBLICATIONS

English Language Abstract JP No. 2000-291557.
English Language Abstract JP No.2001-020865.
English Language Abstract JP No.2001-280552.
English Language Abstract JP No.2002-070743.
English Language Abstract JP No.2002-115686.
English Language Abstract JP No.2002-174178.
English Language Abstract JP No.2002-180984.
English Language Abstract JP No.2002-188574.
English Language Abstract JP No.2002-285981.
English Language Abstract of JP 2002-005024.

* cited by examiner

ELECTRIC COMPRESSOR WITH INVERTER

The present disclosure relates to subject matter contained in priority Japanese Patent Application No. 2002-355228, filed on Dec. 6, 2002, the contents of which is herein expressly incorporated by reference in its entirety.

BACKGROUND OF THE INVENTION

1. Field of the Invention

The present invention relates to an electric compressor having a compression mechanism for sucking, compressing and discharging fluid, an electric motor for driving the compression mechanism, and a housing for containing the compression mechanism and the motor, in which the electric motor is driven by an inverter.

2. Description of the Related Art

In the electric compressor of this kind, an inverter, and a compression mechanism and an electric motor are installed separately from one another (refer to, for example, Japanese Patent Laid-Open Publication Nos. 2000-291557 (patent document 1), 2002-070743 (patent document 2), 2002-174178 (patent document 3), 2002-180984 (patent document 4), 2002-188574 (patent document 5), 2002-285981 (patent document 6)). Electric compressors disclosed in the patent documents 1 to 5, except for an electric compressor shown in FIG. 3 of the patent document 3, are provided with a partition for dividing a housing into a compressor chamber and an inverter chamber in an axial direction. The compressor chamber contains a compression mechanism and an electric motor, and the inverter chamber contains an inverter. The compression mechanism sucks a returned refrigerant from space outside of the housing between the partition and the compression mechanism to compress it, and discharges the compressed refrigerant out of the housing, wherein the electric motor side is defined as a suction side, and the other side is defined as a discharge side. The inverter faces the suction side across the partition to exchange heat with the refrigerant sucked into the compression mechanism, so that the inverter is prevented from being heated by heating parts. In the electric compressor shown in FIG. 3 of the patent document 3, an inverter is externally provided around the middle of the housing on the suction side, in order to exchange heat with the refrigerant to be sucked. In an electric compressor disclosed in the patent document 6, an inverter is externally provided in the middle of a housing, which contains a compression mechanism and an electric motor, over a compression mechanism installation area and a part of an electric motor installation area. The high heating portion of the inverter is thermally combined with the inlet of the refrigerant sucked into the compression mechanism, so that the inverter is cooled.

A housing of an electric compressor with an inverter installed therein needs an exclusive part, as compared with an electric compressor an electric motor of which is not driven by an inverter, because the structure of them are partly different. Such an exclusive part increases manufacturing cost due to increase in the types of parts of the housing. Even if the inverter is externally provided around the middle of the housing, an inverter attachment portion is so formed in the housing as to flatly protrude on one side of a radial direction. Therefore, the electric compressors with and without the inverter need respective exclusive part, so that cost increases after all.

In the electric compressor with the inverter externally provided in the housing, the attachment portion makes the housing large on one side of the radial direction aside from the inverter itself. Thus, the electric compressor becomes large and heavy. Especially in FIG. 3 of the patent document 3, many fins, which extend to the vicinity of a cylindrical surface formed by a stator of the electric motor, are formed on the flat inner surface of the attachment portion, so that the electric compressor becomes heavier. In the inverter of the patent document 6, a switching device as a high heating portion is divided from a capacitor the heating value of which is lower. Only the switching device is thermally combined with the returned refrigerant, and hence the protrusion area of the attachment portion is smaller than the whole inverter. When both the switching device and the capacitor are thermally combined with the returned refrigerant, however, the protrusion area becomes as large as that shown in FIG. 3 of the patent document 3.

In the patent documents 1 to 6, the refrigerant is discharged outside from the compression mechanism without passing through an electric motor side. Consequently, it is difficult to isolate lubricating oil from the discharged refrigerant for the purpose of improving the performance of a refrigerating cycle, because the lubricating oil has to be isolated during the process of discharge to the outside. Thus, a full and large-scale isolation apparatus as disclosed in the patent document 6 is necessary, whereby the housing becomes large and heavy.

The electric compressor according to the patent documents 1 to 6 is hard to be installed in a small engine room. When the electric compressor is installed in an electric vehicle or a gasoline-electric hybrid vehicle, drive power obtained from batteries is not as high as that of a gasoline vehicle. Thus, miniaturization and weight reduction are the most important challenges for the electric compressor, but the ordinary one is hard to achieve them.

In the patent documents 1 to 5, the returned refrigerant sucked on the electric motor side is used for cooling the electric motor before being sucked to the compression mechanism. The returned refrigerant, however, hardly contains the lubricating oil, so that lubrication tends to be insufficient in portions, in which the lubricating oil is not mechanically supplied, such as the bearing of the end of a drive shaft on the electric motor side which is far from the compression mechanism. In the patent document 6, the midpoint of a passage for sucking the returned refrigerant into the compression mechanism is connected to the electric motor side. To cool the electric motor, used are a part of the sucked refrigerant stagnating in the electric motor side, and heat and refrigerant moving forward and backward in accordance with difference in pressure and temperature between the suction passage of the returned refrigerant and the electric motor side. The performance of cooling the electric motor is inferior, in addition to the insufficiency of lubrication as with the patent documents 1 to 5. These problems adversely affect the lifetime and performance of the electric compressor.

SUMMARY OF THE INVENTION

An object of the present invention is to provide an electric compressor with an inverter, which cools the inverter without an upsized housing or an exclusive part.

To achieve the above object, an electric compressor according to one aspect of the invention includes: a compression mechanism for sucking, compressing and discharging fluid; an electric motor for driving the compression mechanism; a housing for containing the compression mechanism and the electric motor; and an inverter for driving the electric motor, wherein an inverter case of the inverter is externally attached to an end of the housing in an axial direction on the side of a suction port of the compression mechanism. An intake passage for leading fluid returned from the outside into the suction port is formed in the inverter case, and the intake passage has a thermal binding portion for thermally binding the intake passage to the inverter.

In the above-described structure, since the end wall of the housing in the axial direction is almost flat as compared with a cylindrical wall around the middle of the housing, the inverter case is externally attached without major change in the shape of the housing, irrespective of whether the end wall is on the suction side of fluid or the discharge side thereof, or on a high pressure side or a low pressure side. It is unnecessary to provide an exclusive part in the housing, because returned fluid efficiently cools the inverter in the thermal binding portion, while the intake passage formed in the inverter case leads the returned fluid into the suction port.

An electric compressor according to another aspect of the invention includes: a compression mechanism for sucking, compressing and discharging fluid; an electric motor for driving the compression mechanism; a housing for containing the compression mechanism and the electric motor; and an inverter for driving the electric motor, wherein an inverter case of the inverter is externally attached to an end of the housing in an axial direction on a discharge side from the compression mechanism, and on the side of a suction port of the compression mechanism. An intake passage for leading returned fluid into the suction port is formed in the inverter case. The intake passage has a thermal binding portion for thermally binding the intake passage to the inverter, and an air layer between the intake passage and the end of the housing.

In the above-described structure, since the end wall of the housing in the axial direction is almost flat as compared with the cylindrical wall around the middle of the housing, the inverter case is externally attached without major change in the shape of the housing, on the contrary, with obtaining the air layer between the end wall and the flat inverter case by using the difference in shape between the flat inverter case and the housing. The returned fluid efficiently cools the inverter while the intake passage formed in the inverter case leads the returned fluid into the suction port, so that it is unnecessary to provide an exclusive part in the housing. Even though the inverter is externally attached to the end wall on the discharge side having the suction port, the air layer provided between the housing and the inverter insulates the discharge side at high temperature from the intake passage, thereby maintaining the high cooling efficiency of the inverter by the returned fluid.

Other objects and features of the invention will become more apparent in the following detailed description and accompanying drawings. Each feature of the invention can be adopted either alone or in various possible combinations.

DETAILED DESCRIPTION OF THE PREFERRED EMBODIMENTS

Figure 1:
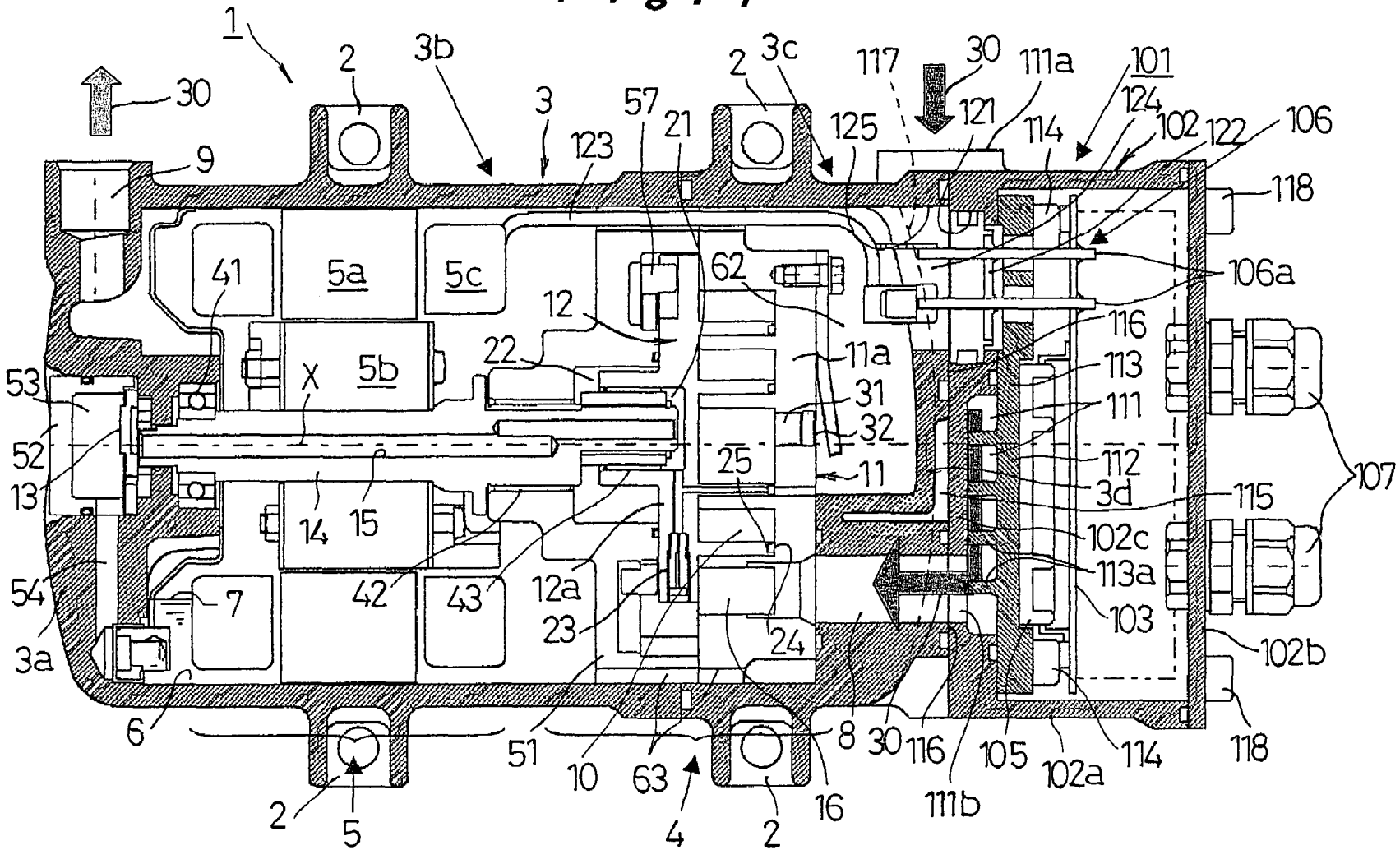
FIG. 1 is a sectional view showing an electric compressor according to an embodiment of the present invention.

An embodiment of an electric compressor according to the present invention will be hereinafter described with reference to FIGS. 1 and 2. An electric compressor 1 according to this embodiment, as shown in FIG. 1, is installed horizontally by mounting legs 2 which are provided on the middle of a housing 3. The electric compressor 1 has the housing 3 which contains a compression mechanism 4, an electric motor 5 for driving the compression mechanism 4, and a reservoir 6 for retaining lubricant to lubricate sliding portions including the compression mechanism 4. An inverter 101 drives the electric motor 5. A gas refrigerant is used as a refrigerant, and lubricating oil 7 is used for lubricating the sliding portions and sealing the sliding portion of the compression mechanism 4. The lubricating oil 7 is compatible with the refrigerant. The present invention, however, does not limited to them, as long as an electric compressor includes a compression mechanism for sucking, compressing and discharging fluid, an electric motor for driving the compression mechanism, a housing for containing the compression mechanism and the electric motor, and an inverter for driving the electric motor.

In this embodiment, the compression mechanism 4 of the electric compressor 1 is a scroll type one that has compression space 10 which is formed by a fixed scroll member 11 and an orbiting scroll member 12 engaged with each other. The fixed scroll member 11 has a fixed end plate 11*a* and blades erected on the plate 11*a*. The orbiting scroll member 12 has an orbiting end plate 12*a* and blades erected on the plate 12*a*. When the electric motor 5 turns the orbiting scroll member 12 via a drive shaft 14 in a circular orbit with respect to the fixed scroll member 11, the volume of the compression space 10 varies, so that a refrigerant 30 returning from an external cycle is sucked from a suction port 8, compressed, and discharged into the external cycle through a discharge port 9. The suction port 8 and the discharge port 9 are provided in the housing 3.

At the same time, by use of a displacement type pump 13 driven by the drive shaft 14, difference in pressure inside the housing 3, or the like, the lubricating oil 7 retained in the reservoir 6 is supplied to a lubricant pool 21 and/or a lubricant pool 22 in the rear face of the orbiting scroll member 12. In this embodiment, the lubricating oil 7 is supplied to the lubricant pool 21 through an oil feeding passage 15 of the drive shaft 14, while the orbiting scroll member 12 turns. A part of the lubricating oil 7 supplied to the lubricant pool 21 is supplied to the rear face of the outer periphery of the orbiting scroll member 12 through the orbiting scroll member 12, with the restraint of a throttle 23 and the like, in order to lubricate the orbiting scroll member 12. Then, the lubricating oil 7 is supplied to a holder groove 25 for holding a chip seal 24 through the orbiting scroll member 12, in order to seal and lubricate between the fixed scroll member 11 and the orbiting scroll member 12. The chip seal 24 as one example of a seal member is so provided at the end of the blade of the orbiting scroll member 12 as to face the fixed scroll member 11. Another part of the lubricating oil 7 supplied to the lubricant pool 21 flows to the side of the electric motor 5, and is recovered into the reservoir 6 after passing through a eccentric bearing 43, the lubricant pool 22, and a main bearing 42 to lubricate the bearings 42 and 43.

The pump 13, a sub bearing 41, the electric motor 5, and a main bearing member 51 having the main bearing 42 and the eccentric bearing 43 are disposed in a main shell 3*b* with an end wall 3*a* in one of the axial directions, in this order from the side of the end wall 3*a*. The pump 13 is disposed on the outer surface of the end wall 3*a*. A lid 52 is fitted over the pump 13 so as to hold the pump 13. A pump chamber 53 is formed inside the lid 52. The pump chamber 53 is connected to the reservoir 6 through the suction passage 54. The sub bearing 41 held by the end wall 3*a* receives the drive shaft 14 on the connection side to the pump 13. The stator 5*a* of the electric motor 5 is fitted into the inner periphery of the main shell 3*b* by shrink fitting or the like, and the rotor 5*b* thereof is fixed in the middle of the drive shaft 14. Thereby, the electric motor 5 rotates the drive shaft 14. The main bearing member 51 is fitted into the inner periphery of the main shell 3*b* by shrink fitting or the like, and the main bearing 42 receives the drive shaft 14 on the side of the compression mechanism 4. The fixed scroll member 11 is secured to the outer surface of the main bearing member 51 with bolts (not illustrated) or the like. The orbiting scroll member 12 is disposed between the main bearing member 51 and the fixed scroll member 11 to form a scroll type compressor mechanism. An anti-autorotation portion 57 such as an Oldham ring or the like, which prevents the autorotation of the orbiting scroll member 12 to promote the rotation in the circular orbit, is disposed between the main bearing member 51 and the orbiting scroll member 12. The drive shaft 14 is connected to the orbiting scroll member 12 via the eccentric bearing 43, so that the orbiting scroll member 12 turns in the circular orbit.

A portion of the compression mechanism 4, exposed from the main shell 3*b* is covered by a sub shell 3*c*. The sub shell 3*c* is secured to the main shell 3*b* with bolts 58 or the like, in such a manner that the openings of the sub shell 3*c* and the main shell 3*b* are opposed to each other. The sub shell 3*c* is provided with another end wall 3*d* which is on the opposite side of the end wall 3*a* in the axial direction. The compression mechanism 4 is positioned between the suction port 8 and the discharge port 9 of the housing 3. The suction port 16 of the compression mechanism 4 is connected to the suction port 8 of the housing 3, and the discharge port 31 of the compression mechanism 4 opens toward the end wall 3*d* via a reed valve 31*a*. A discharge chamber 62 is formed between the reed valve 31*a* and the end wall 3*d*. The discharge chamber 62 is connected to the discharge port 9 of the electric motor 5 between the compression mechanism 4 and the end wall 3*a*, through the fixed scroll member 11 and the main bearing member 51, or through a connection passage 63 formed between the fixed scroll member 11 and the housing 3 and between the main bearing member 51 and the housing 3.

Figure 2:
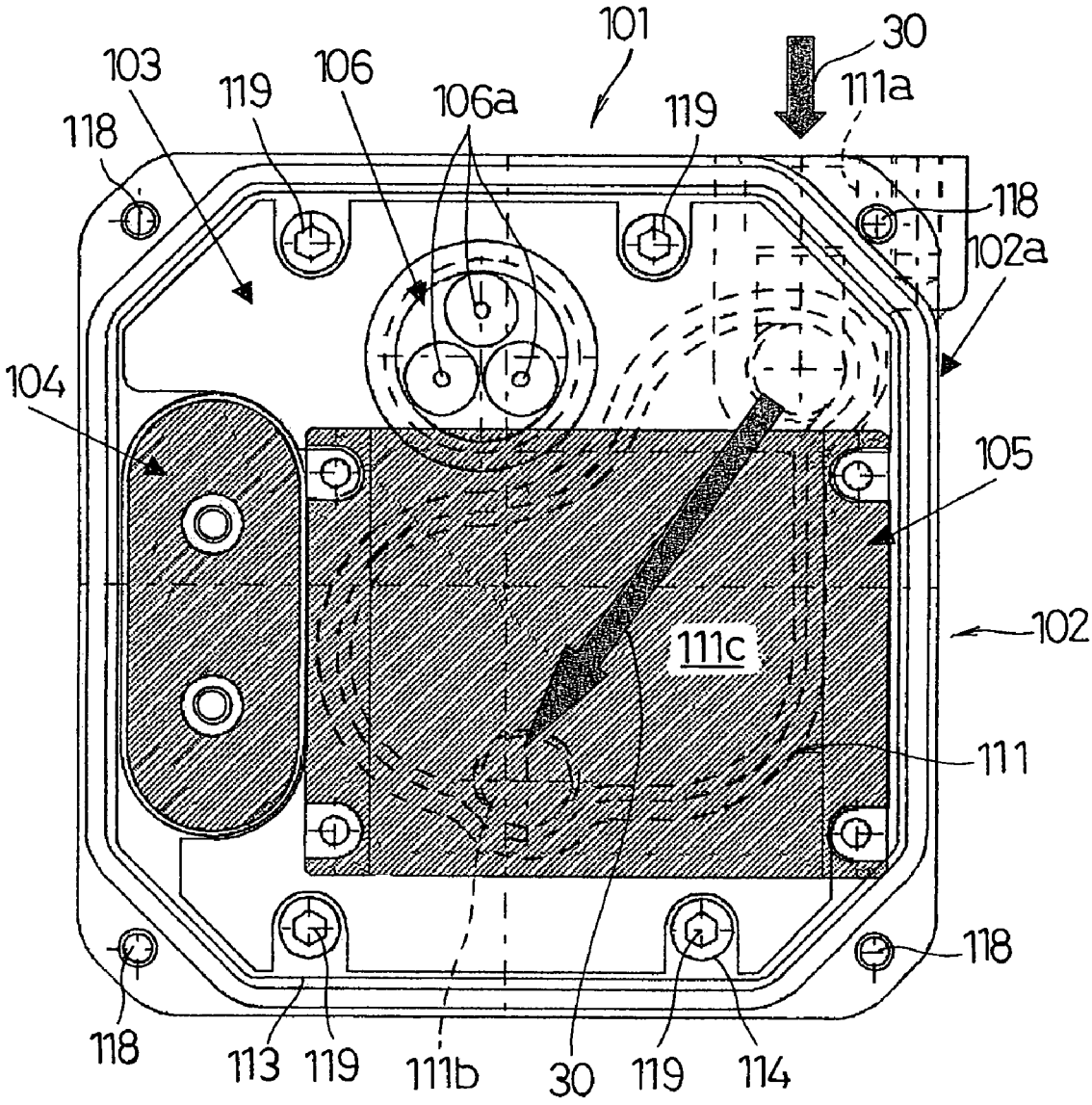
FIG. 2 is a side view of an inverter included in the electric compressor of FIG. 1 when a lid is taken off.

The inverter 101, as shown in FIG. 2, includes a circuit board 103, an electrolytic capacitor 104, and an inverter case 102 for containing the circuit board 103 and the capacitor 104. An IPM (intelligent power module) 105 including the switching device is mounted on the circuit board 103. Since the switching device has a higher heating value than the electrolytic capacitor 104, the IPM 105 is defined as a high heating portion of the inverter 101. The inverter 101 attached to the outside of the housing 3 is electrically connected to the electric motor 5 via a compressor terminal 106, in order to drive the electric motor 5 with monitoring necessary information such as temperature and the like. For this purpose, the inverter 101 is provided with harness connectors 107 which electrically connect the inverter 101 to the outside. To be more specific, in an inverter shell 102*a* one surface of which opens, the circuit board 103 is attached to the bottom of the inverter 101, and the harness connectors 107 are provided in a lid 102*b* for closing the opening of the inverter shell 102*a*.

As described above, the electric motor 5 driven by the inverter 101 turns the compression mechanism 4 in the circular orbit via the drive shaft 14, and drives the pump 13. At this time, while the pump 13 supplies the lubricating oil 7 in the reservoir 6 to the compression mechanism 4 for the purpose of lubrication and seal, the compression mechanism 4 sucks the refrigerant returned from the refrigerating cycle, through the suction port 8 of the housing 3 and the suction port 16 of itself. Then, the compression mechanism 4 compresses and discharges the refrigerant into the discharge chamber 62 from the discharge port 31 of itself. Thus, the discharge chamber 62 between the end wall 3*d* and the compression mechanism 4 is at high temperature and high pressure by the refrigerant just after discharge. The refrigerant discharged into the discharge chamber 62 gets into the side of the electric motor 5 through the connection passage 63 to cool the electric motor 5. Then the refrigerant is supplied to the refrigerating cycle from the discharge port 9 of the housing 3. During the long process between discharge from the compression mechanism 4 and discharge from the discharge port 9, the refrigerant with the lubricating oil 7 also lubricates the sub bearing 41, though a part of the lubricating oil 7 is separated from the refrigerant by various liquid separation methods using collision, centrifugal force, throttle and the like. Accordingly, the side of the electric motor 5 is at low temperature and low pressure as compared with the discharge chamber 62.

In this embodiment, the inverter case 102 of the inverter 101 is externally secured with bolts 118 or the like to the end wall of the housing 3 in an X axial direction on the side of the suction port 8 connected to the compression mechanism 4 (the end wall designates the end wall 3*d* in FIG. 1, but the end wall may be the end wall 3*a* on an opposite side). An intake passage 111 for leading the refrigerant 30, as an example of fluid returned from the outside, to the suction port 8 is formed on the side of the inverter case 102. The intake passage 111 has a thermal binding portion 112 between the intake passage 111 and the inverter 101.

The end wall 3*a* of the housing 3, as shown in FIG. 1, is often formed in a slightly round shape as a pressure container. The end wall 3*a*, however, is almost flat as compared with the cylindrical wall around the middle of the housing 3. Accordingly, with the use of a semi-flat portion such as the end wall 3*a* or the like, the inverter case 102 is externally attached without major change in the shape of the housing 3, irrespective of whether the semi-flat portion is in the suction side of the refrigerant or the discharge side thereof, or in a high pressure side or a low pressure side. The inverter 101 is efficiently cooled by the refrigerant 30 in the thermal binding portion 112 between the intake passage 111 and the inverter 101, during a suction process in which the intake passage 111 formed on the side of the inverter case 102 leads the returned refrigerant 30 into the suction port 8.

As a result, an exclusive part is unnecessary, even though the installed inverter 101 is cooled. The suction port 8 is in an end wall to which the inverter 101 is externally attached, and may be open to the outer periphery of the end wall. Since the suction port 8 is near the inverter 101, the intake passage 111 is almost contained in a thermal binding area by the thermal binding portion 112, due to the little waste of a route of the intake passage 111. Therefore, the housing 3 does not become larger and heavier in excess of the space and weight of the inverter 101.

When the inverter 101 is externally attached to another end wall at low temperature on the suction and low pressure side, cooling performance is not impaired even if the inverter 101 forms the intake passage 111 which is closed by the coupling with the end wall side, whereby the structure is simplified.

It is preferable that the thermal binding portion 112 is made of material with high thermal conductivity, for example, aluminum and aluminum alloy, which are lightweight, are desirable. The thermal binding portion 112 can be made of material which is different from that of the housing 3, the inverter case 102 and the like. In this embodiment, however, both the housing 3 and the inverter case 102 are made of aluminum or aluminum alloy to decrease the weight of the whole electric compressor. The thermal biding portion 112 is composed of a part of a separate board member 113, which forms the intake passage 111 between the inverter case 102 and a bottom wall 102*c*. The size of the board member 113 is almost equal to that of the circuit board 103 of the inverter 101. The circuit board 103 is secured to the board member 113 with bolts 119 or the like via spacers 114, and the IPM 105, as the high heating portion in the circuit board 103, makes tightly contact with the board member 113. The board member 113 has a heat sink function in the contact area to absorb heat from the IPM 105, so that the inverter 101 is efficiently cooled by heat exchange with the sucked refrigerant 30 flowing through the intake passage 111.

For the heat exchange, as shown in FIG. 2, a heat exchange area 111*c* is formed in the intake passage 111. The heat exchange area 111*c* almost extends from an intake 111*a* of the returned refrigerant 30 to the heat binding portion 112 in the way to a connection port 111*b* to the suction port 8. In the heat exchange area 111*c*, fins 113*a* (refer to FIG. 1) extending from the board member 113 gets into the route of the sucked refrigerant 30 (shown by an arrow in FIG. 2) flowing from the intake 111*a* to the connection port 111*b* in order to promote the heat exchange. The fins 113*a* make the route of the sucked refrigerant 30 serpentine and/or diverged, thereby further promoting the heat exchange between the sucked refrigerant 30 and the inverter 101 in the thermal binding portion 112.

The IPM 105 being the high heating portion is positioned next to the heat exchange area 111*c* of the intake passage 111, to cool it prior to the other parts of the inverter 101. The board member 113, however, extends to the approximately whole area of the inverter case 102, so that heat accumulated in the inverter case 102, which includes heat generated by the electrolytic capacitor 104 and the like, is supplied to the heat exchange with the sucked refrigerant 30 in order to increase cooling efficiency.

In this embodiment, since the side of the end wall 3*d*, having the discharge chamber 62 is at high temperature and high pressure, the inverter case 102 of the inverter 101 is externally attached to the end wall 3*d*. The end wall 3*d* having the suction port 8 to the compression mechanism 4 is on the discharge side from the compression mechanism 4. On the side of the inverter case 102, there are the intake passage 111 for leading the returned refrigerant 30 into the suction port 8, the heat binding portion 112 between the intake passage 111 and the inverter 101, and an air layer 115 (refer to FIG. 1) between the intake passage 111 and the end wall 3*d*.

In this embodiment, the end wall 3*d* of the housing 3 is almost flat as compared with the cylindrical wall around the middle of the housing 3. With the use of the semi-flat end wall 3*d*, the inverter case 102 is externally attached without major change in the shape of the housing 3. When the inverter case 102 is attached, the air layer 115 is obtained in the outside of a contact area 116 for attachment, by use of slight difference in shape between the end wall 3*d* and the flat inverter case 102. The intake passage 111 has to be formed in the side of the inverter case 102 independently, but the sucked refrigerant 30 still efficiently cools the inverter 101 at the heat binding portion 112, during the process between the suction of the returned refrigerant 30 into the suction port 8 and the lead thereof in the intake passage 111. The housing 3 does not need an exclusive part for cooling the installed inverter 101 by the sucked refrigerant 30. Even when the inverter 101 is externally attached to the end wall of the discharge side at high temperature, the air layer 115 insulates the discharge side including the discharge chamber 62 from the intake passage 111, thereby maintaining the high cooling efficiency of the inverter 101 by the sucked refrigerant 30.

According to these features, as shown in FIG. 1, the refrigerant 30, discharged from the compression mechanism 4 into the discharge side having the discharge chamber 62, flows to the opposite side having the electric motor 5 and the discharge port 9. The refrigerant 30 is used for cooling the electric motor 5 and lubricating the sliding portions such as the sub bearing 41 far from the compression mechanism 4, and is subjected to liquid separation in sufficiently long passage to the discharge port 9. Then, the refrigerant 30 is discharged out of the housing 3. Stability in the operation of the electric compressor 1 and the durability thereof is thereby increased.

In FIG. 1, the suction port 8 is open to an end face 117 to which the inverter 101 is externally attached. Thereby, the suction port 8 is connected to the connection port 111*b* of the intake passage 111 only by externally attaching the inverter case 102.

Since the heat binding portion 112 is adjacent to the approximately whole area of at least the high heating portion such as the IPM 105, the temperature of the inverter 101 is prevented from partly exceeding predetermined temperature due to insufficient cooling of the high heating portion.

Further, as shown in FIG. 1, since the mounting legs 2 for mounting the electric compressor in such a manner that the axis of the housing becomes horizontal or slanting are symmetrically provided in the housing 3 on the side out of an inverter attachment portion, so that ease of attachment of the inverter 101 to the housing 3 is equal at right and left. The electric compressor 1 is thus suitable for being attached to an engine which is installed in a small engine room of a vehicle.

In the electric compressor 1, the housing 3 is divided in the X axial direction into the sub shell 3*c*, which is on the attachment side of the inverter 101, and the main shell 3*b*. The housing 3 divided in two, can contain the compression mechanism 4 and the electric motor 5, and the inverter case 102 is externally attached to one of the end walls of the housing 3 in the X axial direction. The structure of the electric compressor 1 is simplified, and cost is reduced.

Further, connection pins 106*a* of the compressor terminal 106 are directly connected to the circuit board 103 of the inverter 101, specifically, to an electric circuit formed in printed wiring in the circuit board 103. This eliminates a harness for connecting the connection pins 106*a* to the circuit board 103 and the routing space of the harness.

Furthermore, the compressor terminal 106 has a seal portion 122 in a connection port 121 of the inverter case 102, connected to the inside of the housing 3. Thus, the seal portion 122 shifts outward to the connection port 121. Connection space 124 between the harness 123 extending from a wound wire 5*c* of the electric motor 5 and the connection pins 106*a* of the compressor terminal 106 expands outside due to the shift, as shown in FIG. 1, connecting operation becomes easy. At this time, a seal portion of a compressor terminal of an electric compressor which is not driven by an inverter can be used as the connection port 125 of the housing 3. Or the seal portion of the compressor terminal 106 can be provided in the housing 3, regardless of the presence or absence of an inverter. The inverter case 102 can be formed integrally with the board member 113, and the bottom wall 102*c* can be separate. When the bottom wall 102*c* is separate, it is preferable that the bottom wall 102*c* is made of metal with low thermal conductivity such as stainless steel, or heat insulating nonmetal, in order to further reduce thermal effect from the side of the discharge chamber 62. In this case, the air layer 115 can be omitted. When the bottom wall 102*c* is integral with the inverter case 102, the whole inverter case 102 can be made of metal with low thermal conductivity or heat insulating nonmetal.

According to an electric compressor of this invention, since the end wall of a housing in an axial direction is almost flat as compared with a cylindrical wall around the middle of the housing, an inverter case is externally attached without major change in the shape of the housing, irrespective of whether the end wall is on the suction side of fluid or the discharge side thereof, or on a high pressure side or a low pressure side. This structure eliminates an exclusive part in the housing, because returned fluid efficiently cools an inverter in a thermal binding portion, while an intake passage formed in the inverter case leads the returned fluid into a suction port.

Furthermore, since the end wall of the housing in the axial direction is almost flat as compared with the cylindrical wall around the middle of the housing, an inverter case is externally attached without major change in the shape of the housing, on the contrary, with obtaining an air layer between the end wall and the flat inverter case. The returned fluid efficiently cools the inverter while the intake passage formed in the inverter case leads the returned fluid into the suction port, thereby eliminating an exclusive part in the housing. Even when the inverter is externally attached to the end wall on the discharge side, the air layer provided between the housing and the inverter insulates the discharge side at high temperature from the intake passage, thereby maintaining the high cooling efficiency of the inverter by the returned fluid.

Although the present invention has been fully described in connection with the preferred embodiment thereof, it is to be noted that various changes and modifications apparent to those skilled in the art are to be understood as included within the scope of the present invention as defined by the appended claims unless they depart therefrom.

What is claimed is:

1. An electric compressor comprising:

a compression mechanism which sucks, compresses and discharges fluid;

an electric motor which drives said compression mechanism;

a housing containing said compression mechanism and said electric motor; and an inverter which drives said electric motor, wherein an inverter case of said inverter is externally attached to an end wall of said housing in an axial direction and at a side of said housing having a suction port which introduces fluid into said compression mechanism, an intake passage which returns fluid from an outside of said compressor into said suction port, wherein said suction port is provided in said inverter case, and wherein said intake passage has a thermal binding portion which thermally binds said intake passage to said inverter, said thermal binding portion having a plurality of fins projecting into a fluid path of said intake passage, said inverter case having an end surface connected to an end wall of said housing such that said end surface of the inverter case defines at least part of said intake passage, and said thermal binding portion being positioned within said inverter case.

2. An electric compressor comprising:

a compression mechanism which sucks, compresses and discharges fluid;

an electric motor which drives said compression mechanism;

a housing containing said compression mechanism and said electric motor; and an inverter which drives said electric motor, wherein an inverter case of said inverter is externally attached to an end wall of said housing in an axial direction at a side of said compression mechanism having a discharge port, said end wall having a suction port which returns fluid to said compression mechanism, an intake passage which returns fluid to said suction port, wherein said suction port is provided in said inverter case, and wherein said intake passage has a thermal binding portion which thermally binds said intake passage to said inverter, wherein an air layer is provided between said intake passage and said end wall, and wherein said thermal binding portion has a plurality of fins projecting into a fluid path of said intake passage, said inverter case having an end surface connected to an end wall of said housing such that said end surface of the inverter case defines at least part of said intake passage, and said thermal binding portion being positioned within said inverter case.

3. The electric compressor according to claim 1, wherein said thermal binding portion is positioned adjacent to substantially an entire area of at least a high heating portion of said inverter.

4. The electric compressor according to claim 1 further comprising mounting legs configured to mount said electric compressor either horizontally or at an incline with respect to said axial direction.

5. The electric compressor according to claim 1, wherein said housing is divided into an inverter attachment side and an opposing side provided opposite said inverter attachment side in an axial direction.

6. The electric compressor according to claim 1, further comprising a connection pin of a compressor terminal, which connects said electric motor to the outside, said connection pin being directly connected to a circuit board of said inverter.

7. The electric compressor according to claim 6, wherein said compressor terminal has a seal portion provided in a connection port of said inverter case, the seal portion being connected to an inside of said housing.

8. The electric compressor according to claim 2, wherein said thermal binding portion is positioned adjacent to substantially an entire area of at least a high heating portion of said inverter.

9. The electric compressor according to claim 2, further comprising mounting legs configured to mount said electric compressor either horizontally or at an incline with respect to said axial direction.

10. The electric compressor according to claim 2, wherein said housing is divided into an inverter attachment side and an opposing side provided opposite said inverter attachment side in an axial direction.

11. The electric compressor according to claim 2, further comprising a connection pin of a compressor terminal, which connects said electric motor to the outside, said connection pin being directly connected to a circuit board of said inverter.

12. The electric compressor according to claim 11, wherein said compressor terminal has a seal portion provided in a connection port of said inverter case, the seal portion being connected to an inside of said housing.

* * * * *